US005993275A

United States Patent [19]

Lavorata

[11] Patent Number: 5,993,275

[45] Date of Patent: Nov. 30, 1999

[54] HIGH-CAPACITY LIFE RAFT

[75] Inventor: Marc Lavorata, Paris, France

[73] Assignee: Zodiac International, Issy les Moulineaux, France

[21] Appl. No.: 08/986,264

[22] Filed: Dec. 5, 1997

[30] Foreign Application Priority Data

Dec. 6, 1996 [FR] France ..... 96 15023

[51] Int. Cl.[6] ..... B63B 35/58

[52] U.S. Cl. ..... 441/38; 114/345

[58] Field of Search ..... 114/345; 441/35, 441/37–40, 44

[56] References Cited

FOREIGN PATENT DOCUMENTS

WO 9514605 6/1995 Australia .

1162793 8/1969 United Kingdom ..... 441/38

2131369 6/1984 United Kingdom .

2232138 12/1990 United Kingdom .

*Primary Examiner*—Jesus D. Sotelo

*Attorney, Agent, or Firm*—Dean W. Russell; Kilpatrick Stockton LLP

[57] ABSTRACT

High-capacity life raft (1, 10) comprising an inflatable peripheral edge (2) forming a tubular buoyancy chamber and a central bottom (3) secured thereto, characterized in that the said central bottom (3) comprises at least one region (4) forming a platform for receiving those embarking and at least one region (5) for mustering those who have embarked, the said muster region (5) occupying an area of the said bottom that is quite distinctly larger than the area occupied by the said reception platform region (4).

15 Claims, 4 Drawing Sheets

HIGH-CAPACITY LIFE RAFT

The present invention relates to improvements made to high-capacity life rafts comprising an inflatable peripheral edge forming a tubular buoyancy chamber and a central bottom secured thereto.

At the present time, common practice as regards equipping high-capacity ships (cruise liners, car ferries, etc.) with life-saving equipment, is to provide a floating platform that forms a pontoon onto which people emerge from an evacuation means (steps, slide, chute, dinghy, etc.) and to which the actual life rafts intended to receive the evacuated people are moored.

This floating platform thus merely forms an intermediate stage between that part of the evacuation means that is at water level and the life raft itself and, in theory, is not in any way designed for people to remain on it. It therefore forms part of the evacuation equipment as do the steps, slides, chutes, etc. and may even be mechanically secured to them and deployed at the same time they are. This platform therefore does not count as a craft capable of taking people on board. Nevertheless, even though it does not carry any of the equipment carried by a life raft (shelter, gear, survival equipment, communications equipment, etc.) its cost is far from negligible.

What is more, this platform needs to be maintained and inspected regularly just like all the other life-saving equipment, and these inspections and maintenance take a long time and are expensive.

Finally, it should also be noted that once the evacuated people reach this platform they have to get onto the life raft moored to it, by stepping over the two inflatable tubular chambers that border both the platform and the raft. In heavy seas and for panic-stricken and traumatized people, and also for the elderly, the infirm or children, this transfer operation is difficult and plays a part in considerably slowing down the filling of the life raft.

Thus, there is an urgent need to simplify the procedures of loading evacuated people onto high-capacity life rafts in order, on the one hand, to speed up as far as possible the rate at which people can be evacuated, especially from the high-capacity ships currently in service or on the drawing board (cruise liners, car ferries, etc.) and, on the other hand, to reduce as far as possible the amount of evacuation equipment carried, both because of its own cost and because of the costs of maintaining and inspecting it.

For these reasons, a high-capacity life raft like the one mentioned in the preamble and in accordance with the invention, is essentially characterized in that the said central bottom comprises

- at least one region forming a platform for receiving those embarking, and
- at least one region for mustering those who have embarked,
- the said muster region occupying an area of the said bottom that is quite distinctly larger than the area occupied by the said reception platform region.

By virtue of this layout, it is the life raft itself which, because one of its regions is organized in a suitable way, acts as a pontoon for receiving the evacuated people, who are then immediately directed towards the muster region, thereby leaving the reception region clear.

This thus gives a saving in materials, both as regards the equipment and inspection and maintenance. Evacuation is simplified because the people can very easily, and therefore very quickly, get from the reception area to the muster area, this operation in particular being far easier for the elderly and infirm, children, anyone who is injured, etc.

In addition, this type of life raft is of general use: it is suitable for quickly evacuating ships of all sizes, especially ones which have various freeboard heights: cruise liners, packet steamers, car ferries, which stand high out of the water, or high-speed vessels which sit low in the water; it can be used in conjunction with any means for evacuating people from the ship: dinghies, slides, chutes, steps for ships that stand high out of the water, and also with small slides, or even simple inclined gangways for ships that sit low in the water.

Finally, it can be positioned in any desired way relative to the ship, either some distance from the hull for long inclined evacuation means, or up against the hull for short or vertical evacuation means.

For very high capacity rafts (for example, to give a clearer idea, of the order of 100 persons), it is advisable to provide two regions for mustering those who have come on board, these regions being situated one on either side of a centrally-situated reception platform region; in this case, it is also advisable for the raft to have an elongate overall shape and for the two muster regions to occupy the end parts of the raft, which gives an easier overall layout. However, this arrangement is by no means the only one, and provision could also be made for the raft to have an elongate shape and for at least one muster region to occupy an end part of the raft and the reception platform region to occupy the other end part of the raft: in this way a much larger space can be made available which, for example, will make it easier for the raft to cooperate with the evacuation means in heavy seas.

As the reception platform region is open and therefore exposed to rain and sea water, it is advantageous for it to be designed so that any water taken in is removed automatically (so-called "self-draining" area). In addition, as the region or regions in which people are mustered are preferably designed so that the people will be protected from rainwater and sea water, it is advisable for the reception platform region to be separated from the region for mustering those who have embarked by watertight partitioning means. In particular, these means may consist of one or more inflatable tubular chambers which extend transversely across the bottom of the raft at the boundary between the two regions and which are connected in watertight fashion to the bottom and, at their ends, to the peripheral tubular chamber of the raft. This being the case, this or these inflated tubular chambers may also act as stiffeners, and it is possible for additional ones to be provided in the muster region or regions with the sole purpose of mechanically strengthening the raft, especially in the case of very-high-capacity rafts of elongate shape like the ones mentioned earlier.

For safety reasons, and so as to be sure that the raft can be used irrespective of how it enters the water, it is beneficial for the raft to be of a so-called "self-righting" type or possibly to be reversible.

Moreover, to form extremely high-capacity life-preserving units (for example 150 or 200 or even 250 people) filling at a very high rate, it would be difficult to produce unit rafts with a capacity as high as this. Provision can therefore be made for a raft in accordance with the invention to have means fitted to its sides and allow it to be moored alongside at least one other life raft so as to form a multiple life-preserving unit.

In practice, provision will be made for the region or regions for mustering those who have embarked to be equipped with a shelter. It should at this point be noted that once the raft has been filled and has moved away from the ship in distress, the reception platform region no longer plays an active role, or at least not until the rescue operation during which it will act as the platform from which the people will be evacuated. Thus, since it does not have an active role, this region can be occupied by those who have embarked and it is advisable for it to be possible for a lightweight and readily removable auxiliary shelter to be erected over the reception platform region.

In conclusion, a life raft designed in accordance with the invention offers an appreciable saving in the equipment of vessels and in the maintenance and inspection of life-preserving equipment, means that evacuated people are able to take up their places in the shelters of the raft more quickly, is very flexible in its use because it is suitable for all types of ship and all types of evacuation means, can give people an enhanced sense of security since they are united in greater numbers and can make it easier to treat those who are injured, makes it possible to form an extremely high-capacity unit by mooring several rafts alongside each other (for example two identical rafts in accordance with the invention, or alternatively a raft in accordance with the invention and a raft equipped with an all-over shelter, or even a raft in accordance with the invention flanked on either side by two rafts with all-over shelters); and finally the number of seamen needed to operate the raft, to embark people, and then to take command of the raft can be appreciably reduced compared to life-preserving units of a smaller capacity.

The invention will be better understood from reading the detailed description which follows of certain embodiments which are given simply by way of non-limiting examples. In this description, reference is made to the appended drawings in which.

Figure 1:
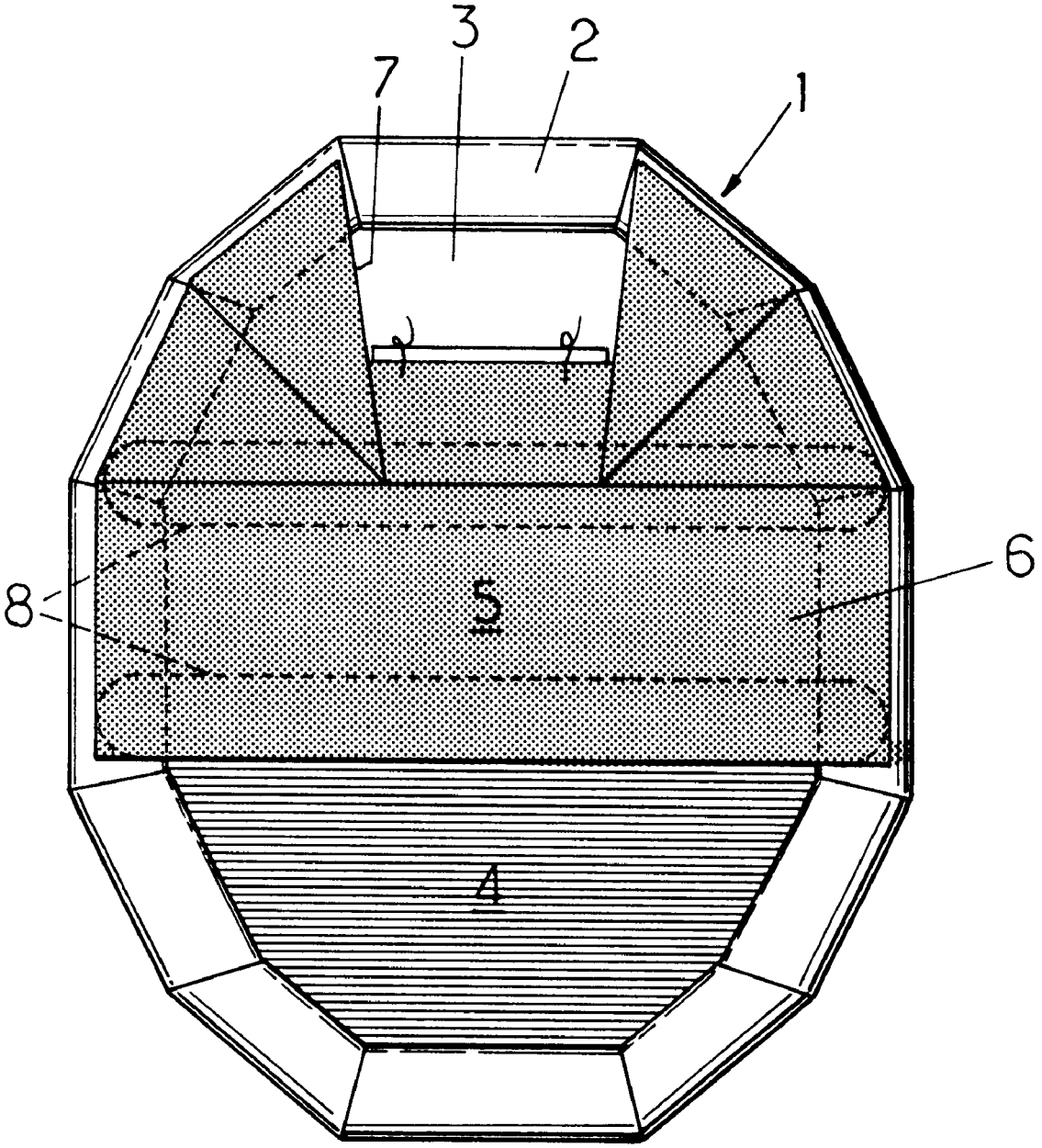
FIG. 1 is a plan view of a high-capacity life raft designed in accordance with the invention.

Referring first of all to FIG. 1, this depicts a high-capacity life raft (for example, to give a clearer idea, for approximately 50 people) of the inflatable type, denoted overall by the reference 1. This raft comprises, in particular and in a way which is generally known, an inflatable peripheral edge 2 forming a tubular buoyancy chamber, arranged in any desirable way, for example either in the form of a single large-diameter tubular chamber or in the form of two or three superimposed tubular chambers. The inside of the space defined by this peripheral edge is occupied by a bottom 3 secured in a watertight way to the said edge. The raft is also equipped with inflation equipment, navigation gear and possibly survival gear, which have not been shown.

However, the structural layout of the raft and its equipment do not form part of the invention and may be of any type, depending on the envisaged conditions of use.

That part of the raft that is delimited by the peripheral edge 2, in other words the bottom 3, consists of two regions:

first of all a clear region 4 forming a platform on which to receive those embarking from evacuation means (not shown), then a region 5 for mustering those who have embarked, this region having the function, on the one hand, of accommodating those who have embarked so as to leave the platform region 4 free for new arrivals and, on the other hand, thanks to the use of a shelter 6 (as is commonly provided on this kind of craft), to allow those who have embarked to shelter from the wind, the rain and green seas.

It will be noted that the platform region 4 occupies an area which is appreciably smaller than the muster region 5.

The shelter 6 is designed in accordance with the regulations laid down on this subject, with an opening (not visible) allowing communication with the platform area 5, and with lateral openings, such as 7. Inflatable hoops 8 hold the shelter up.

It is advisable for the platform region 4 to be designed so that any rainwater and sea water falling on it will automatically be removed (so-called "self-draining" region). Likewise, to keep the shelter dry, it is advisable for watertight protection means to separate the platform region 4 from the muster region 5: these means may in particular consist of a transverse inflatable tubular chamber (situated vertically below a hoop 8 and therefore not visible in FIG. 1) which is secured in a watertight way to the bottom 3 and, at its ends, to the peripheral tubular chamber; this inflatable tubular chamber also acts as a stiffener improving the rigidity of the craft and, especially in the case of long rafts, additional similar tubular chambers could possibly be provided solely for this purpose.

It is also advisable for the raft 1 to be of the self-righting or reversible type so that it will be operational irrespective of how it enters the water.

It might prove beneficial to provide a light-weight and readily removable auxiliary shelter intended to cover the platform area 4 once the raft has been filled and has moved away from the ship in distress.

It will be readily understood that a life raft designed as has just been described does not rely on a specific evacuation means or on a particular kind of ship and is therefore of universal use. In particular, incorporating a platform region for receiving those who have been evacuated means that the evacuation equipment no longer needs to include a special raft forming a pontoon whose sole function is to receive the people and which theoretically fulfils no survival function thereafter.

Furthermore, the layout in accordance with the invention offers a great deal of flexibility in the design and/or use of the life rafts.

Figure 2:
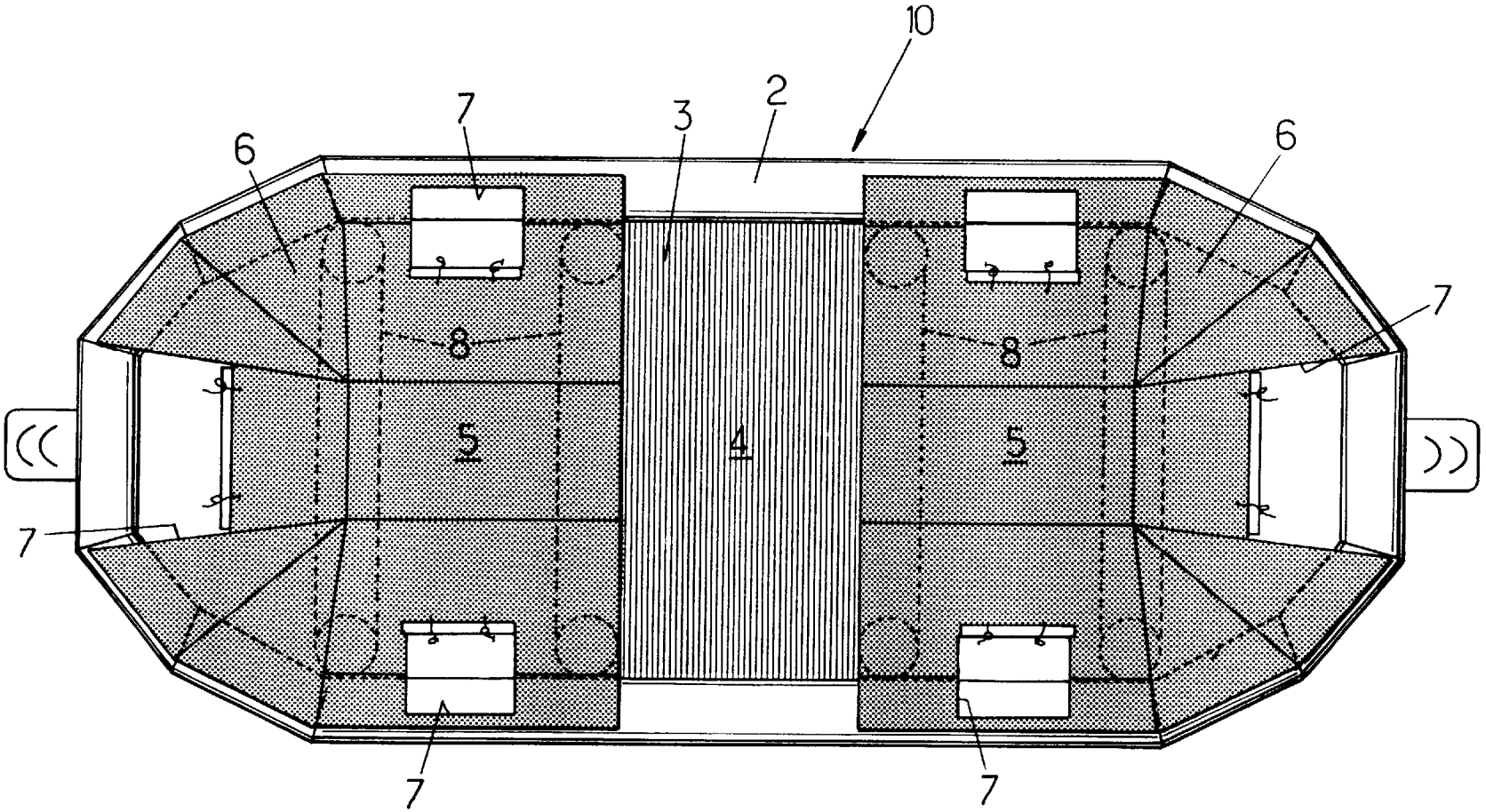
FIG. 2 is a plan view of a very high-capacity life raft designed in accordance with the invention on the basis of the arrangements shown in FIG. 1.
Figure 3:
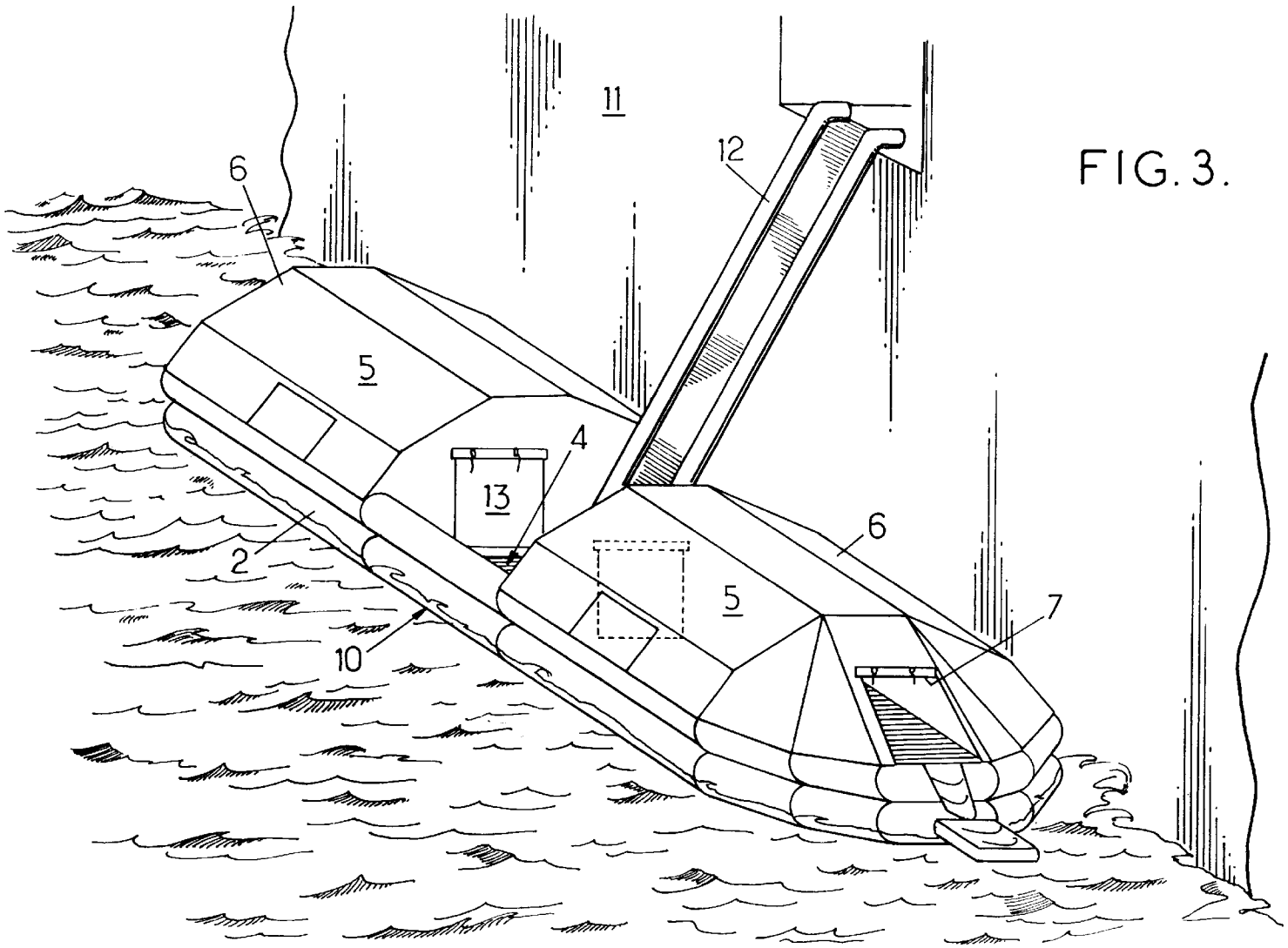
FIG. 3 is a perspective view of the raft of FIG. 2.

In particular, very high-capacity rafts (for example, to give a clearer idea, approximately 100 to 150 people), like the one illustrated in FIGS. 2 and 3, can be produced. This raft, denoted overall by the reference 10, has two regions 5 for mustering those who have embarked, which regions are situated one on either side of a central reception platform region 4. In all other respects both the raft itself and the platform region 4 and muster regions 5 may be laid out in the way mentioned earlier.

Although the layout illustrated in FIG. 2 can be incorporated in a raft of any shape, it will be understood that it is quite particularly suited to a raft of elongate overall shape, in which the muster regions 5 occupy the end parts, as can be seen in FIGS. 2 and 3.

In FIG. 3, the raft 10 is shown in perspective in a position for receiving people to be evacuated from a ship 11 alongside which it is moored. By way of example, it has been assumed that the evacuation means consisted of a slide 12 leading directly onto the central platform region 4. FIG. 3 depicts passages 13 giving access to one of the muster regions 5 from the reception region 4.

Once the raft has been filled and has moved away from the ship, a canvas can be stretched between the two shelters 6, over the central region 4, in order to form a lightweight shelter over the latter.

Again, in the case of a raft of elongate shape, provision may be made, by way of an alternative, for a muster region (with a single shelter or two juxtaposed shelters) to occupy an end region of the raft while the reception platform region occupies the other end of the raft. The larger empty space gives a greater degree of freedom so that the raft can be made to cooperate positively with the evacuation means in heavy seas.

Figure 4:
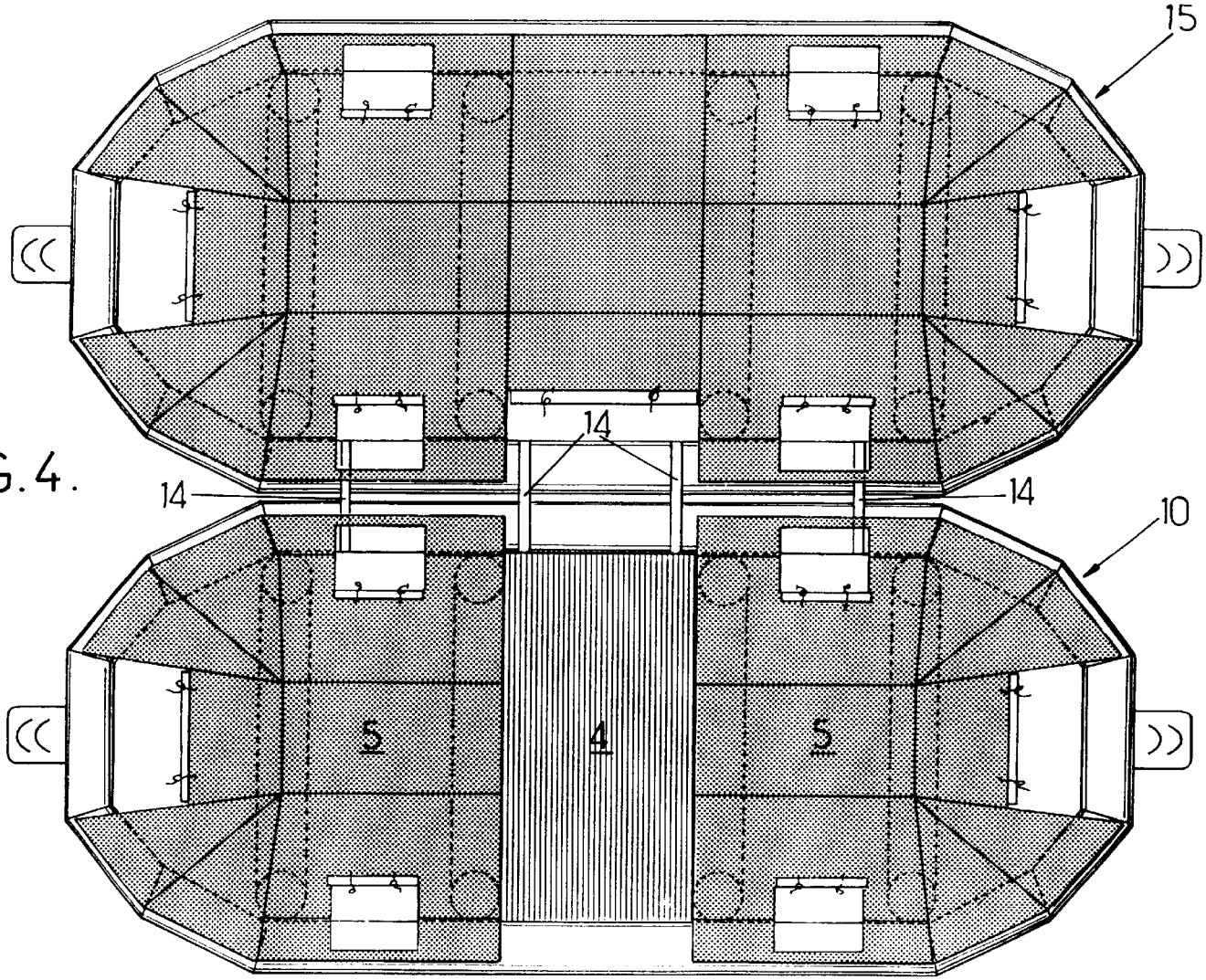
FIG. 4 is a plan view of an example of an extremely high-capacity life-preserving unit incorporating the raft of FIGS. 2 and 3.

If it is required to form extremely high-capacity life-preserving units, it is possible to moor two or more rafts, at least one of which is designed in accordance with the invention, alongside one another. Depicted in FIG. 4 is such a unit consisting of a raft 10 analogous to the one in FIGS. 2 and 3 moored, by mooring means 14 provided on its sides, alongside another raft 15 which may be of the same design as the raft 10 or alternatively, as illustrated, be of a type with an all-over shelter: it is then the platform region 4 of the raft 10 which is used for embarking people onto the raft 15. Another raft 15 could also be moored along the other side of the raft 10, which would also be used for embarking people onto this raft.

Needless to say, and as is already clear from the foregoing, the invention is not in any way limited to those applications and embodiments which have been specifically envisaged; on the contrary, it encompasses all alternative forms thereof.

I claim:

1. High-capacity life raft comprising an inflatable peripheral edge forming a tubular buoyancy chamber and a central bottom secured thereto, the central bottom comprising:

at least one region forming a platform for receiving those embarking, the receiving platform region initially being uncovered when people are embarking, and at least one region for mustering those who have embarked, the mustering region defining a maximum height above the bottom and occupying an area of the bottom that is quite distinctly larger than the area occupied by the reception platform region and the uncovered receiving platform region being open at least to the maximum height of the muster region.

2. Life raft according to claim 1 in which the at least one muster region comprises two regions for mustering those who have come on board, these regions being situated one on either side of the reception platform region.

3. Life raft according to claim 2 having an elongate overall shape and in which the two muster regions occupy the end parts of the raft.

4. Life raft according to claim 1 having an elongate overall shape and in which the at least one muster region occupies an end part of the raft and the reception platform region occupies the other end part of the raft.

5. Life raft according to claim 1 in which the reception platform region comprises a self-draining area for removing automatically any water taken in.

6. Life raft according to claim 5 in which the reception platform region is separated from the region for mustering those who have embarked by watertight partitioning means.

7. Life raft according to claim 1 configured to be self-righting when it enters the water.

8. Life raft according to claim 1 in which means are fitted to its sides and allow it to be moored alongside at least one other life raft so as to form a multiple life-preserving unit.

9. Life raft according to claim 1 in which the region for mustering those who have embarked is equipped with a shelter.

10. Life raft according to claim 1 further comprising a removable auxiliary shelter erected over the reception platform region at least once people have embarked.

11. Life raft according to claim 1 configured to be reversible.

12. Life raft comprising an inflatable peripheral edge forming a tubular buoyancy chamber and a central bottom secured thereto, the central bottom comprising (i) a region forming a platform for receiving those embarking and (ii) at least two regions for mustering those who have embarked, the muster regions being situated one on either side of the reception platform and occupying an area of the bottom that is larger than the area occupied by the reception platform region.

13. Life raft comprising an inflatable peripheral edge forming a tubular buoyancy chamber and a central bottom secured thereto, the central bottom comprising (i) at least one region forming a platform for receiving those embarking and (ii) at least one region for mustering those who have embarked, the muster region occupying an area of the bottom that is larger than the area occupied by the reception platform region and the reception platform region comprising a self-draining area for removing automatically any water taken in.

14. Life raft configured so as to have at least one characteristic selected from the group consisting of (i) being self-righting when it enters the water and (ii) being reversible, the raft comprising an inflatable peripheral edge forming a tubular buoyancy chamber and a central bottom secured thereto, the central bottom comprising (i) at least one region forming a platform for receiving those embarking and (ii) at least one region for mustering those who have embarked, the muster region occupying an area of the bottom that is larger than the area occupied by the reception platform region.

15. Life raft comprising:

a. an inflatable peripheral edge forming a tubular buoyancy chamber;

b. a central bottom secured thereto and comprising:

i. at least one region forming a platform for receiving those embarking; and ii. at least one region for mustering those who have embarked, the muster region occupying an area of the bottom that is larger than the area occupied by the reception platform region; and c. a removable auxiliary shelter erected over the reception platform region at least once people have embarked.

* * * * *